United States Patent [19]

Csont

[11] Patent Number: 4,742,986

[45] Date of Patent: May 10, 1988

[54] APPARATUS FOR CONSTRUCTING CONCRETE BUILDINGS

[76] Inventor: Ernest Csont, P.O. Box 5107, Winter Park, Fla. 32793

[21] Appl. No.: 796,355

[22] Filed: Nov. 7, 1985

[51] Int. Cl.[4] ..... E04G 1/22; E04G 17/14

[52] U.S. Cl. ..... 249/210; 182/179; 182/223; 249/13; 249/18; 249/27

[58] Field of Search ..... 249/13, 18, 19, 26, 249/28, 207, 210, 27; 182/179, 223

[56] References Cited

U.S. PATENT DOCUMENTS

| | | | |
|---|---|---|---|
| 1,060,914 | 5/1913 | Lillow | 182/179 |
| 1,740,958 | 12/1929 | Pitou | 182/179 |
| 2,556,611 | 6/1951 | Borgman | 182/223 |
| 3,047,931 | 8/1962 | Boettner | 249/18 |
| 3,071,206 | 1/1963 | Kristen | 182/179 |
| 3,940,105 | 2/1976 | Metrailer | 249/18 |
| 4,015,395 | 4/1977 | Gostling | 182/179 |
| 4,078,759 | 3/1978 | Lanier | 249/18 |
| 4,123,032 | 10/1978 | Teschner | 249/210 |
| 4,248,024 | 2/1981 | Dahlström | 249/28 |
| 4,426,060 | 1/1984 | Csont | 249/13 |

FOREIGN PATENT DOCUMENTS

| | | | |
|---|---|---|---|
| 2019044 | 11/1970 | Fed. Rep. of Germany | 182/179 |

*Primary Examiner*—Jay H. Woo
*Assistant Examiner*—James C. Housel
*Attorney, Agent, or Firm*—Hobby, Wiggins & Beusse

[57] ABSTRACT

Apparatus for constructing modular buildings in which a reuseable framing structure is expanded to a shape desired of a building, building material is removably attached to the framing structure, fluent concrete is introduced to the building material, the framing structure is retracted with the building and removed. The framing structure has means for expanding its height and width. It also has means for changing the slope of its roof portion as well as changing the angles of its sides. Thus, many different shaped building can be constructed with the same framing structure.

22 Claims, 7 Drawing Sheets

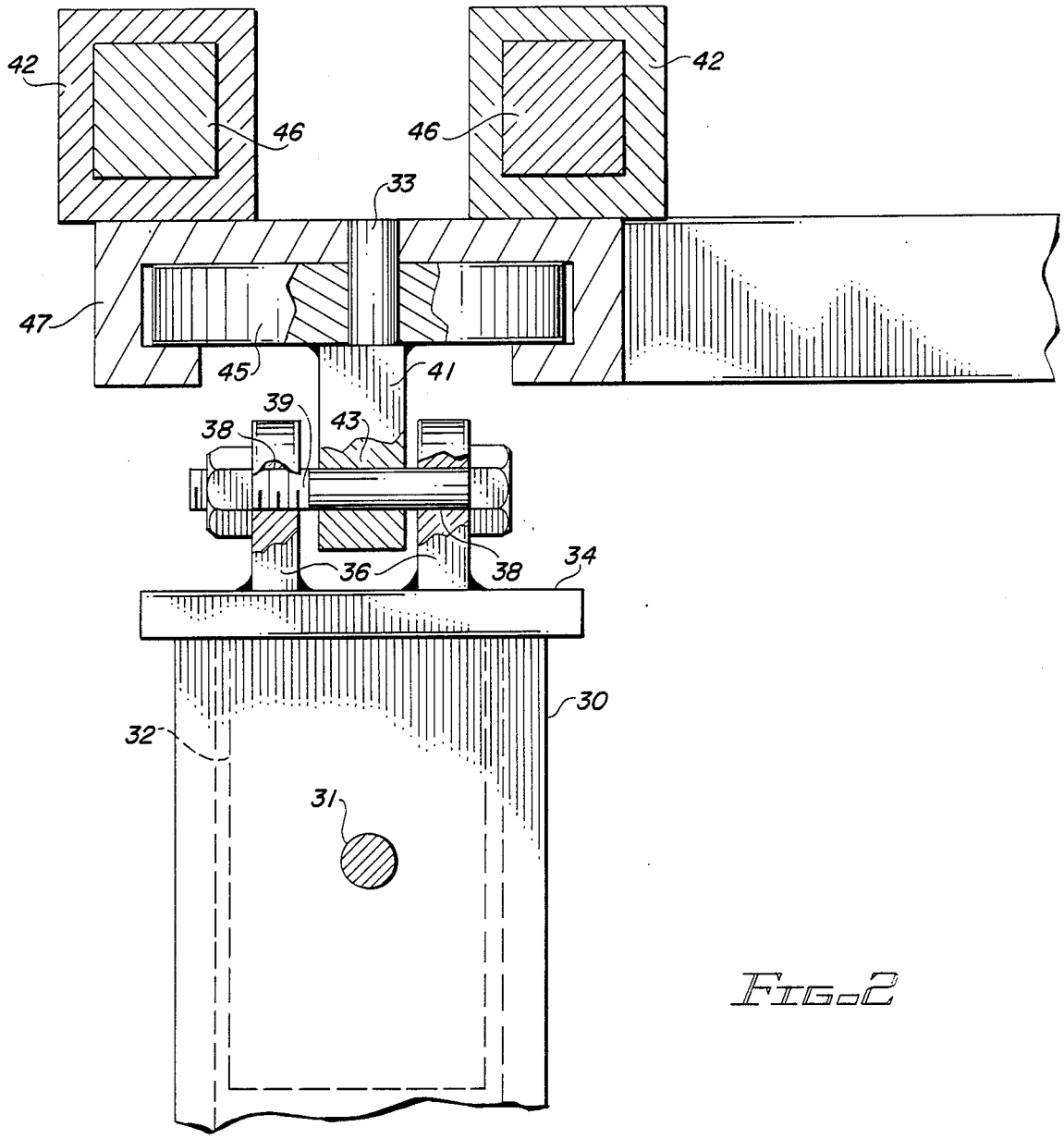
FIG. 2
FIG. 6
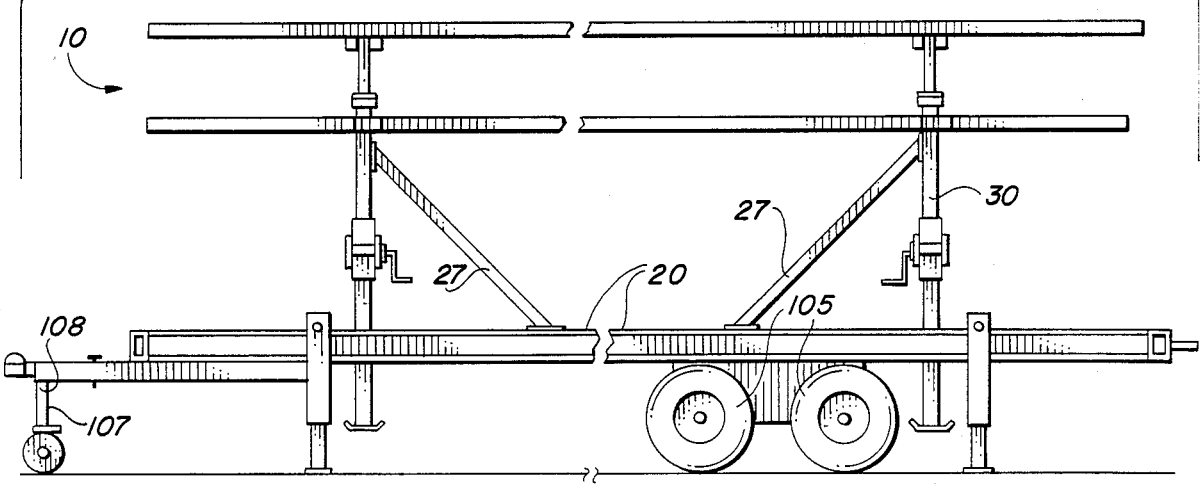

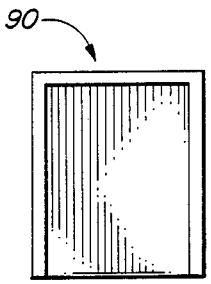
FIG. 11
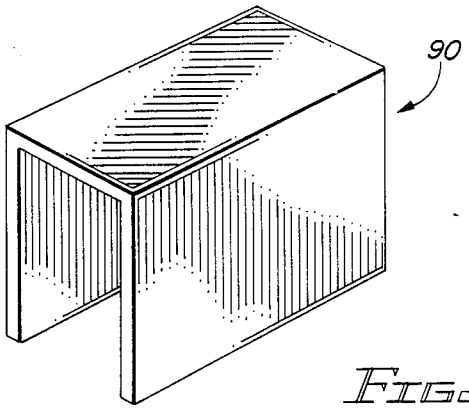
FIG. 12
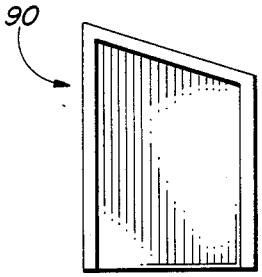
FIG. 13
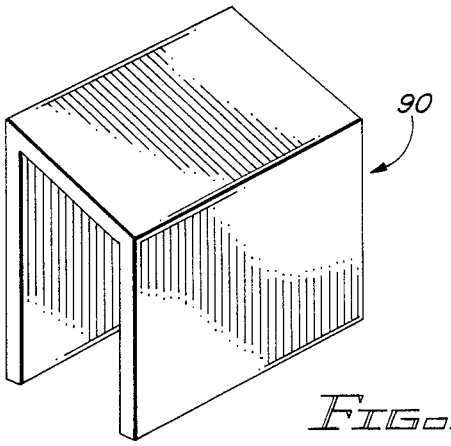
FIG. 14
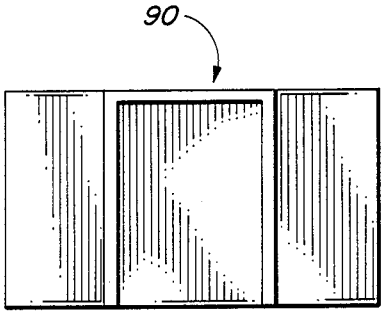
FIG. 15
FIG. 16
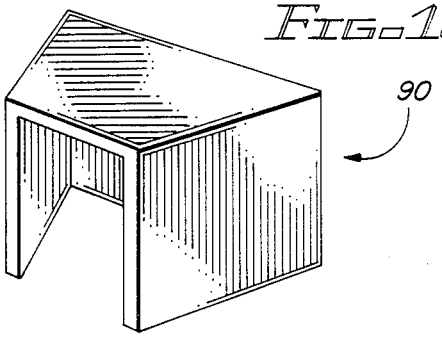
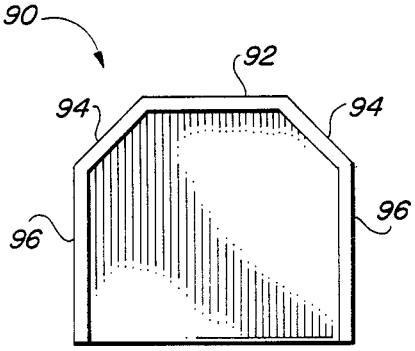
FIG. 17
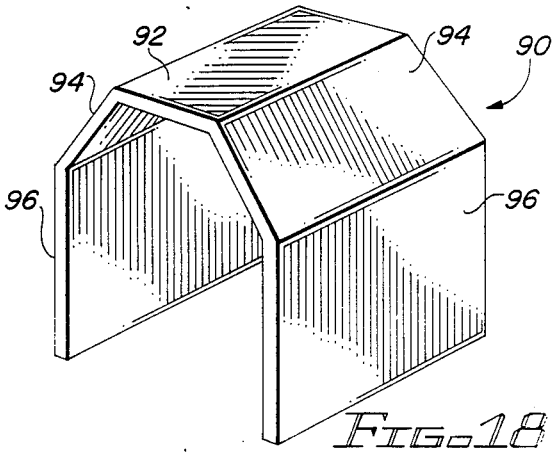
FIG. 18

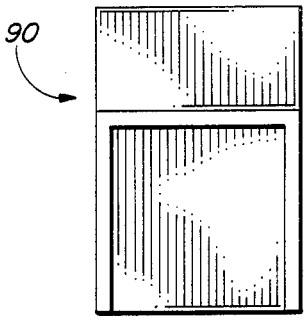
FIG. 19
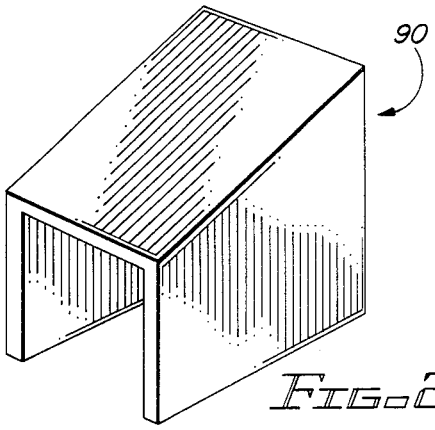
FIG. 20
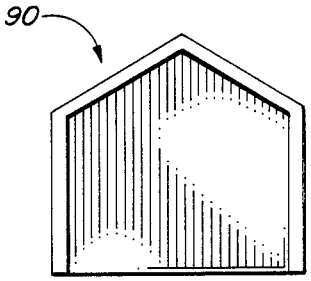
FIG. 21
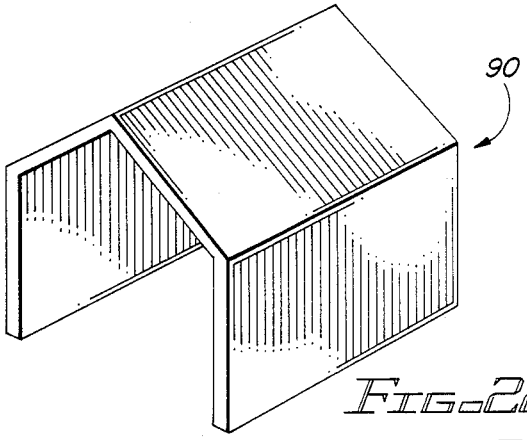
FIG. 22
FIG. 24
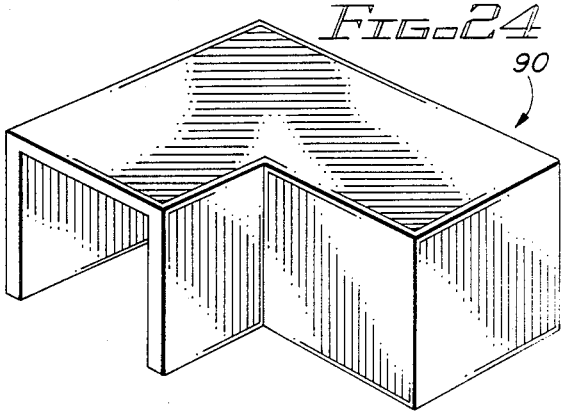
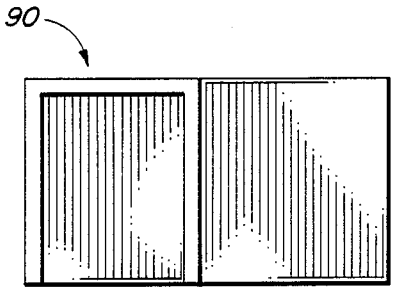
FIG. 23
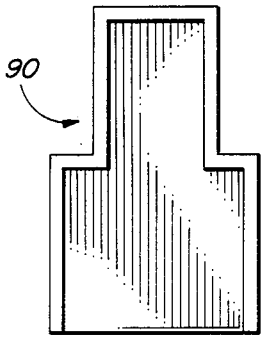
FIG. 25
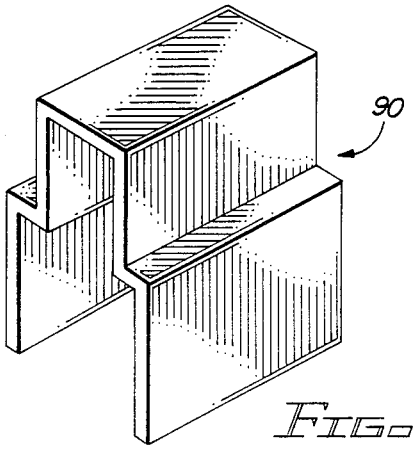
FIG. 26

APPARATUS FOR CONSTRUCTING CONCRETE BUILDINGS

BACKGROUND OF THE INVENTION

This invention relates to concrete buildings and, more particularly, to an apparatus and method for producing concrete buildings.

Various apparatus for producing modular buildings have been designed and used in the construction industry for a long period of time. Modular building units are often built with apparatus that can be continually reused to produce concrete shells for such modular buildings. Buildings constructed with most of these devices require a considerable amount of labor, a fair part of which must be relatively skilled. Many forms used for constructing modular concrete units are collapsible and designed for assembly and disassembly within the concrete unit. Considerable time for erection and disassembly of such forms is incurred for many of these prior art systems; such time and the skilled or relatively skilled labor require significantly increases the cost of these housing units.

My U.S. Pat. No. 4,426,060 discloses an apparatus and method for constructing a modular concrete shell housing unit which requires very little skilled labor. Although the invention in that patent significantly reduces the labor and cost of constructing modular housing units, the size and shape of the building to be constructed is limited to the size and shape of the apparatus itself.

It is an object of the present invention to provide an improved apparatus and method for constructing buildings.

It is a further object of the present invention to construct various size buildings with the same apparatus.

It is still a further object of the present invention to construct various shape buildings with the same apparatus.

It is still a further object of the present invention to provide an apparatus which is relatively lightweight and easily transported.

SUMMARY OF THE INVENTION

The present invention teaches a reusable framing structure for constructing buildings. The building to be constructed is formed around the framing structure and therefore takes the shape of the framing structure. Its dimensions can be varied so that different shaped buildings can be constructed with the same framing structure. Additionally, its height and width can be varied so that different sized buildings can be constructed with the same framing structure.

In accordance with the preferred embodiment of the present invention, the framing structure comprises a lower frame portion having two longitudinally extending beams and two transverse beams connecting the longitudinally extending beams with a plurality of upwardly telescoping vertical masts having lower ends connected to the lower frame portion. A roof frame portion is attached to the upper ends of the vertical masts and the roof frame portion can be raised or lowered by the telescoping of the vertical masts. Additionally, the pitch of the roof frame portion can be changed by raising or lowering one or more of the vertical masts relative to the other masts. Two longitudinal rafter beams are each coplanarly attached to a longitudinal side of the roof frame portion. The rafter beams are attached in such a way that the beams can be projected transversely to increase the width of the roof frame portion as well as permitting the coplanar angles of the rafter beams to be changed. Two longitudinal intermediate beams, traversing respective longitudinal sides of the framing structure, are connected to the masts in such a way that the intermediate beams can be projected transversely to increase the width of the framing structure.

In a preferred embodiment, the framing structure is expanded to the shape desired of the building to be constructed. A plurality of three-dimensional wire matrix panels having a polyurethane insulation core with a portion of the wire matrix protruding from both faces of the insulation core is removably attached to the outside portion of the framing structure. Wih the panels in place, a fluent concrete or the like is introduced to the outside faces of the wire matrix panels and the concrete is permitted to harden in situ. The framing structure is then disconnected from the wire matrix panels and retracted within the constructed building so that a fluent concrete or the like can be introduced to the inside faces of the matrix panels to provide the interior walls and ceiling of the building. In addition to forming the building, the framing structure can also be used as scaffolding during work performed within the building. To construct the floors within a multi-story building, the roof frame portion of the framing structure can be lowered to the height desired of a floor, matrix panels attached to the top of the roof frame portion and concrete introduced to the top faces of the panels. The roof frame portion can then be lowered to the desired height of another floor and the sequence repeated. Thus, the floors are constructed within the building, beginning with the top floor first. Once the framing structure is no longer needed within the building it can be fully retracted and removed from the building.

The framing structure can also be used in conjunction with one or more similar framing structures to provide still larger and more varied buildings. Framing structures can also be stacked one on top of the other in order to construct a taller building. Thus, the framing structure for constructing concrete buildings is highly versatile.

BRIEF DESCRIPTION OF THE DRAWINGS

The foregoing and other objects, features and advantages of the invention will become more apparent by reference to the accompanying drawings and the following detailed description taken in conjunction with the accompanying drawings, in which:

FIG. 2 is a plan view of a connection between a vertical mast and the roof frame portion of a framing structure in accordance with the preferred embodiment;

FIG. 6 is a plan view of a framing structure having wheels;

FIG. 11 is a front plan view of a rectangular building constructed with a single framing structure;

FIG. 12 is a perspective view of the building in FIG. 11;

FIG. 13 is a front plan view of a building having a pitched roof formed by a framing structure;

FIG. 14 is a perspective view of the building in FIG. 13;

FIG. 15 is a front plan view of a building having non-parallel vertical walls formed by a single framing structure;

FIG. 16 is a perspective view of the building of FIG. 14;

FIG. 17 is a front plan view of a building having a horizontal roof portion, two pitched side roof portions and two vertical side walls, formed by a single framing structure;

FIG. 18 is a perspective view of the building in FIG. 17;

FIG. 19 is a front plan view of a building having a longitudinally pitched roof formed by a single framing structure;

FIG. 20 is a perspective view of the building in FIG. 19;

FIG. 21 is a front plan view of a building having a gabled roof formed by two framing structures;

FIG. 22 is a perspective view of the building in FIG. 21;

FIG. 23 is a front plan view of an L-shaped building formed by two framing structure;

FIG. 24 is a perspective view of the building in FIG. 23;

FIG. 25 is a front plan view of a tall building formed with two framing structures stacked one on top of the other; and FIG. 26 is a perspective view of the building in FIG. 25.

DESCRIPTION OF THE PREFERRED EMBODIMENT

Figure 1:
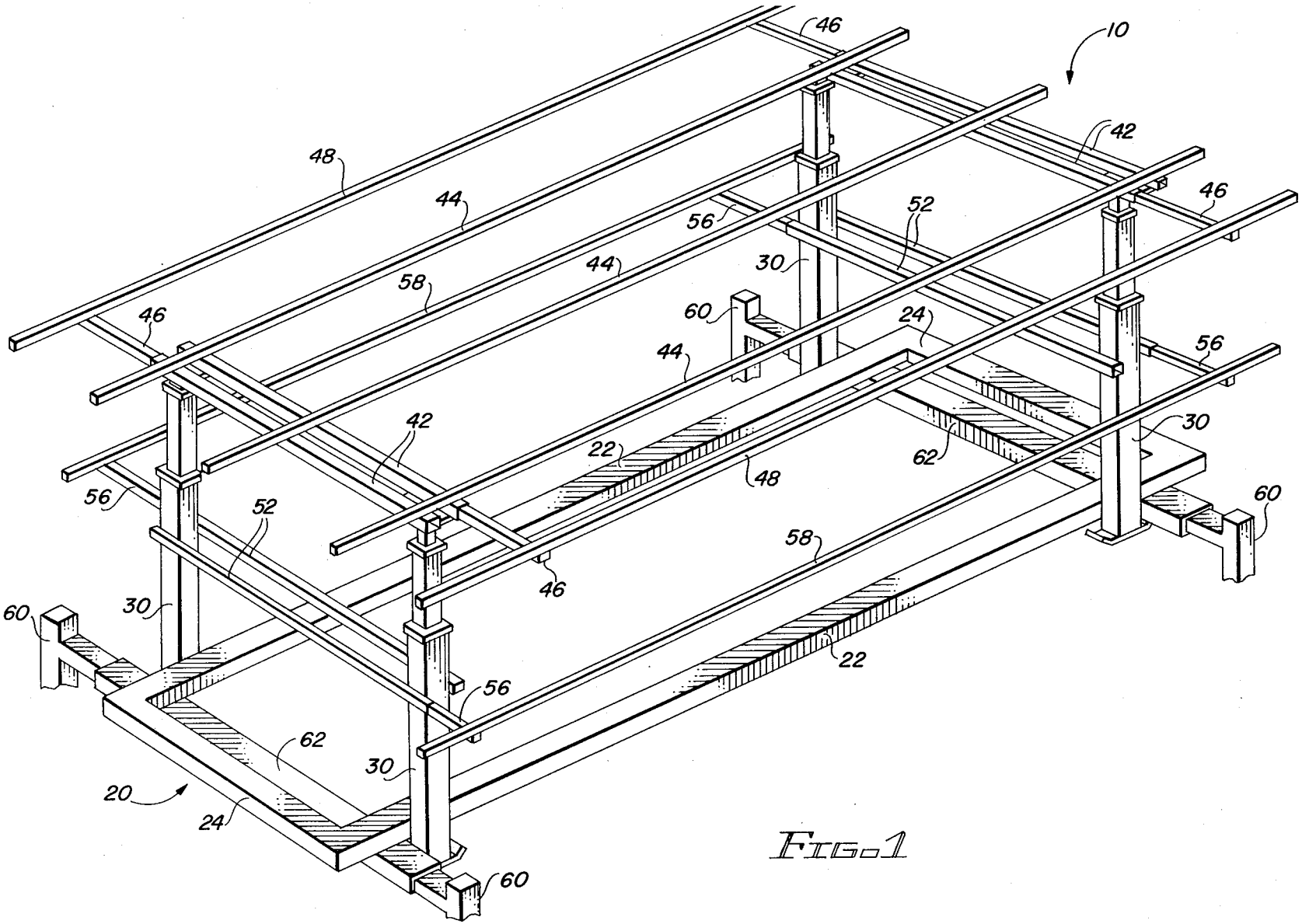
FIG. 1 is a perspective view of a framing structure in accordance with the present invention.

A detailed description of the preferred embodiment of the present invention will now be described with reference to FIG. 1. The framing structure of the present invention, referred to generally with a reference numeral 10, has a lower frame portion 20, four vertical telescoping masts 30 having lower ends connected to the lower frame portion 20, and a roof frame portion 40 attached to the upper ends of the vertical masts 30. The lower frame portion 20 has two parallel longitudinally extending beams 22 and two parallel transverse beams 24 connecting the longitudinally extending beams 22 so that the lower frame portion 20 is in the form of a horizontal rectangle. One of the upwardly telescoping masts 30 is attached near each end of the two longitudinally extending beams 22 in such a way that four planes defined by the masts 30 form a rectangular box. The masts 30 are of a winch type of upwardly telescoping masts such as those available from the Sumner Manufacturing Company, Inc. of Houston, TX under the name Roust-A-Bout.

The roof frame portion 40 is attached to the upper ends of the vertical masts 30 and can be raised, lowered, or pitched with the masts 30. The roof frame portion 40 has four transverse telescoping roof beams 42, two of which traverse the top end of two of the four masts 30 with the other two traversing the top ends of the other two masts 30. A description of the connections between the transverse roof beams 42 and the upper ends of the masts 30 is given below in the discussion of FIG. 2. A plurality of longitudinal roof beams 44, preferably three, traverse the transverse roof beams 42. Preferably the longitudinal beams 44 are welded to the transverse beams 42. The telescoping ends 46 of each pair of transverse roof beams 42 telescope in opposite directions. Two longitudinal rafter beams 48 are each attached to the telescoping ends 46 of the transverse roof beams 42 which telescope in the same direction. Details of the connections between the telscoping ends 46 and the longitudinal rafter beams 48 is given in the discussion of FIG. 4 below.

Four transverse telescoping intermediate beams 52 are attached in pairs to the non-telescoping portions of the masts 30 with one pair traversing two masts 30 with the other pair traversing the other two masts 30 with the telescoping portions 56 of each pair telescoping in opposite directions. Preferably, the telescoping intermediate beams 52 are welded to the vertical masts 30. The longitudinal intermediate beams 58 are each attached to the telescoping ends 56 of two telescoping intermediate beams 52 which telescope in the same direction. The connections of the longitudinal intermediate beams to the telescoping portion 56 of the intermediate beams 52 will be described in detail below with reference to FIG. 4.

In the preferred embodiment of the present invention jacking means are attached to the lower frame portions 20 to raise, lower, or stabilize the framing structure 10. Four jacks 60, well known in the art, are each attached near the four corners of the lower frame portion 20. Preferably, a transverse telescoping lower beam 62 which telescopes in both directions is rigidly attached to the lower frame portion 20 with two of the four jacks 60 rigidly attached to the respective telescoping portions of the transverse lower beam 62. Thus, at least two of the jacks 60 can be transversely extended to increase the stability of the framing structure 10.

Reference is now made to FIG. 2 which illustrates the connection of each transversely telescoping roof beams 42 to the upper end of each corresponding vertical masts 30. Here, the top end of a tube 32, dimensioned to fit within each vertical mast 30, is attached to a horizontal plate 34 which prevents the tube 32 from falling through the vertical mast 30. A pair of vertical parallel plates 36, 36' is attached to the upper face of the horizontal plate 34 with aligned bores 38, 38' through both vertical plates 36, 36'. A vertical pivot plate 41 is pivotally sandwiched between the pair of vertical plates 36, 36' and connected by way of a pin 39 which passes through both aligned bores 38, 38' through the pair of parallel vertical plates 36, 36' and an aligned bore 43 through the vertical pivot plate 41. The upper end of the vertical pivot plate 41 is attached to a horizontal sliding plate 45 which slides within a horizontal track 47 connected to the bottom faces of the transversely telescoping roof beams 42. Referring to FIG. 1 in conjunction with FIG. 2, as the roof frame portion 40 is sloped, the distance between the corresponding top ends of the vertical masts 30 increases, just as the hypotenuse of a triangle increases as one of its legs increases. Thus, as the roof frame portion 40 is sloped by raising corresponding vertical masts 30, the sliding plate 45 slides within the track 47 to account for the increased distance between the top ends of the vertical masts 30.

Figure 3:
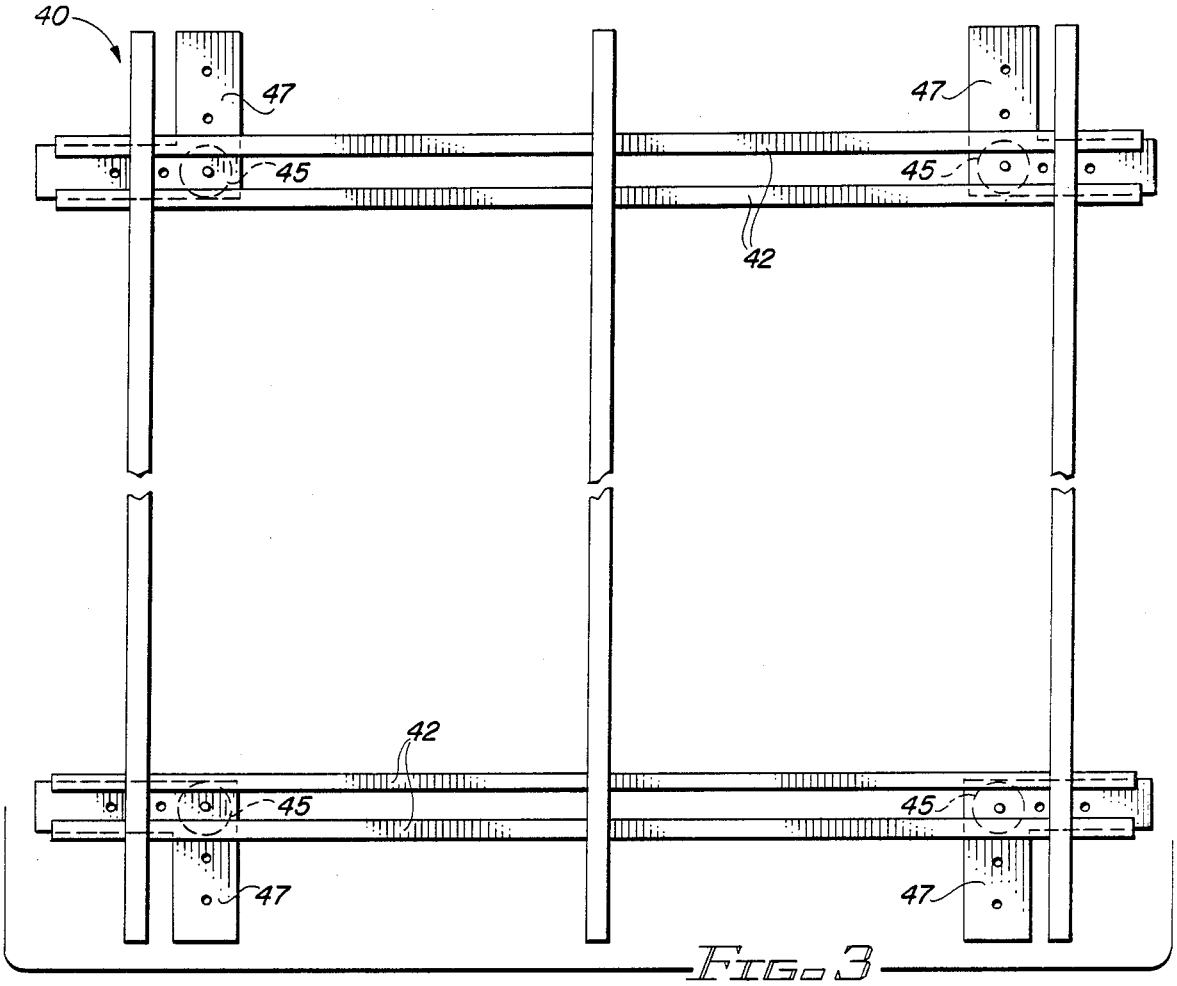
FIG. 3 is a top view of the roof frame portion of a framing structure in accordance with the preferred embodiment.

Reference is now made to FIG. 3 which illustrates a corresponding track 47 above each vertical mast (not shown). Each track 47 is in the form of an "L" with each leg of the "L" protruding outward relative to the roof frame portion 40. When the roof frame portion 40 is completely horizontal, each sliding plate 45 is located near the apex of each track 47. The legs of the tracks 47 in which the sliding plates 45 will slide depends upon the slope of the roof frame portion 40. If the roof frame portion 40 has a longitudinal pitch, the sliding plates 45 will slide within the legs of the tracks 47 which protrude longitudinally. If the roof frame portion 40 is pitched transversely, the sliding plates 45 will slide within the legs of the channels 47 which protrude transversely outward. Referring again to FIG. 2, it is noted that the sliding plate 45 and the pivot plate 43 pivot about a single axis. Thus, the entire joint assembly must be rotated within each vertical mast 30 to align the pivot axis so that the slope of each sliding plate 45 corresponds with the slope of the roof frame portion 40 as well as the slope of each horizontal track 47. A pressure pin 31 is provided through the vertical mast 30 to lock the joint assembly once it is in the desired position. Additionally, pressure pins 33 are provided through the top of the tracks 47 in order to lock the sliding plates 45 to the tracks 47 once the sliding plates 45 are in a desired position.

Figure 4:
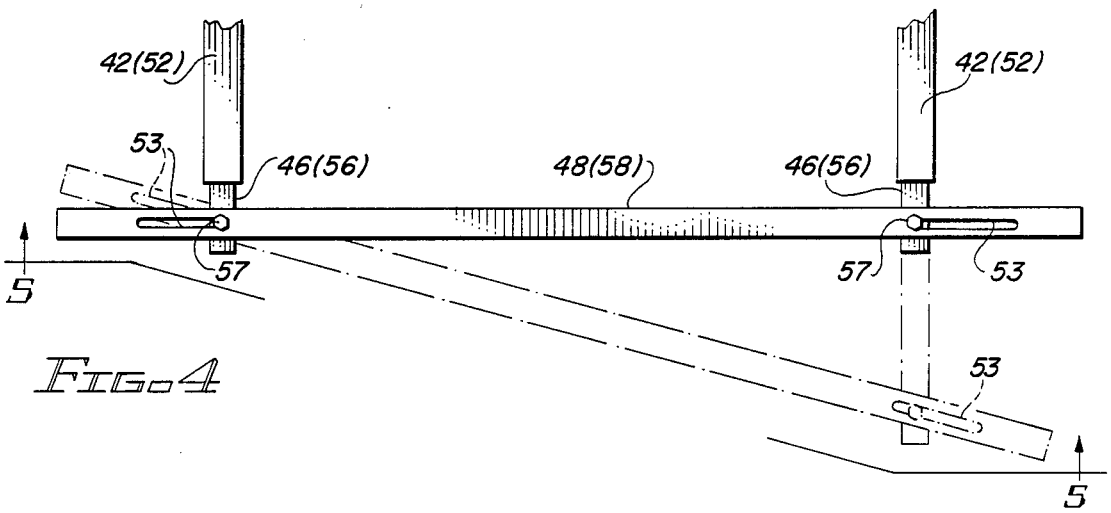
FIG. 4 is a top section view of a longitudinal rafter beam connected to the telescoping portions of transversely telescoping roof beams of a framing structure in accordance with the preferred embodiment.
Figure 5:
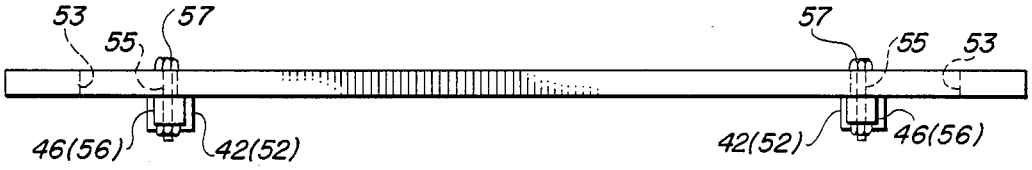
FIG. 5 is a side view 5—5 of FIG. 4.

Reference is now made to FIGS. 4 and 5 which illustrate the connections of the longitudinal rafter beams 48 to the telescoping portions 46 of the transversely telescoping roof beams 42 as well as the connections between the intermediate longitudinal beams 58 and the telescoping portions 56 of the transversely telescoping intermediate beams 52. Here, if a longitudinal beam 48 (58) is projected at an angle, the distance between the ends of the telescoping portions 46 (56) increases just as the hypotenuse of a right triangle increases as one of its legs increases. Thus, the connection between the longitudinal beams 48(58) and the telescoping portions 46 (56) must accommodate this increase in distance. This is accomplished by providing slots 53 near both ends of each longitudinal beams 48(58) in which vertical pins 55 passing through the slots 53 pivotally connects the longitudinal beams 48(58) to the telescoping portion 46(56) of the transversely telescoping beams 42(52). Thus, the longitudinal beams 48(58) are slidably and pivotally connected to the telescoping portions 46(56) to effectively increase the length of the longitudinal beams 48(58) when the distance between the ends of the corresponding telescoping portions 46(56) increases. Additionally, once the beams are in their desired position the pins 55 can be locked down by nuts 57 at each end of each pin, or other means well known in the art to provide a rigid structure.

Reference is now made to FIG. 6 which illustrates the framing structure of FIG. 1 provided with wheels 105 so that the framing structure 10 can be easily transported from one site to another site. Additionally, a telescoping wheel structure 107, well known in the art, can be provided near the front of the framing structure to stabilize the framing structure 10 when it is supported by its wheels 105 rather than its jacking means. A towbar 108, well known in the art, is also provided near the front of the framing structure 10 so that the framing structure can be pulled by an appropriate vehicle. Bracing beams 27 having one end attached to the lower frame portion 20 and another end attached to the vertical masts 30 can be provided to increase the structural strength of the framing structure 10.

In one embodiment of the present invention the framing structure in its retracted position is approximately 24 feet long, 8 feet high, and 8 feet wide. It is capable of expanding to nearly 24 feet high and 24 feet wide. Thus, a wide range of various size buildings can be constructed with the same framing structure.

Figure 7:
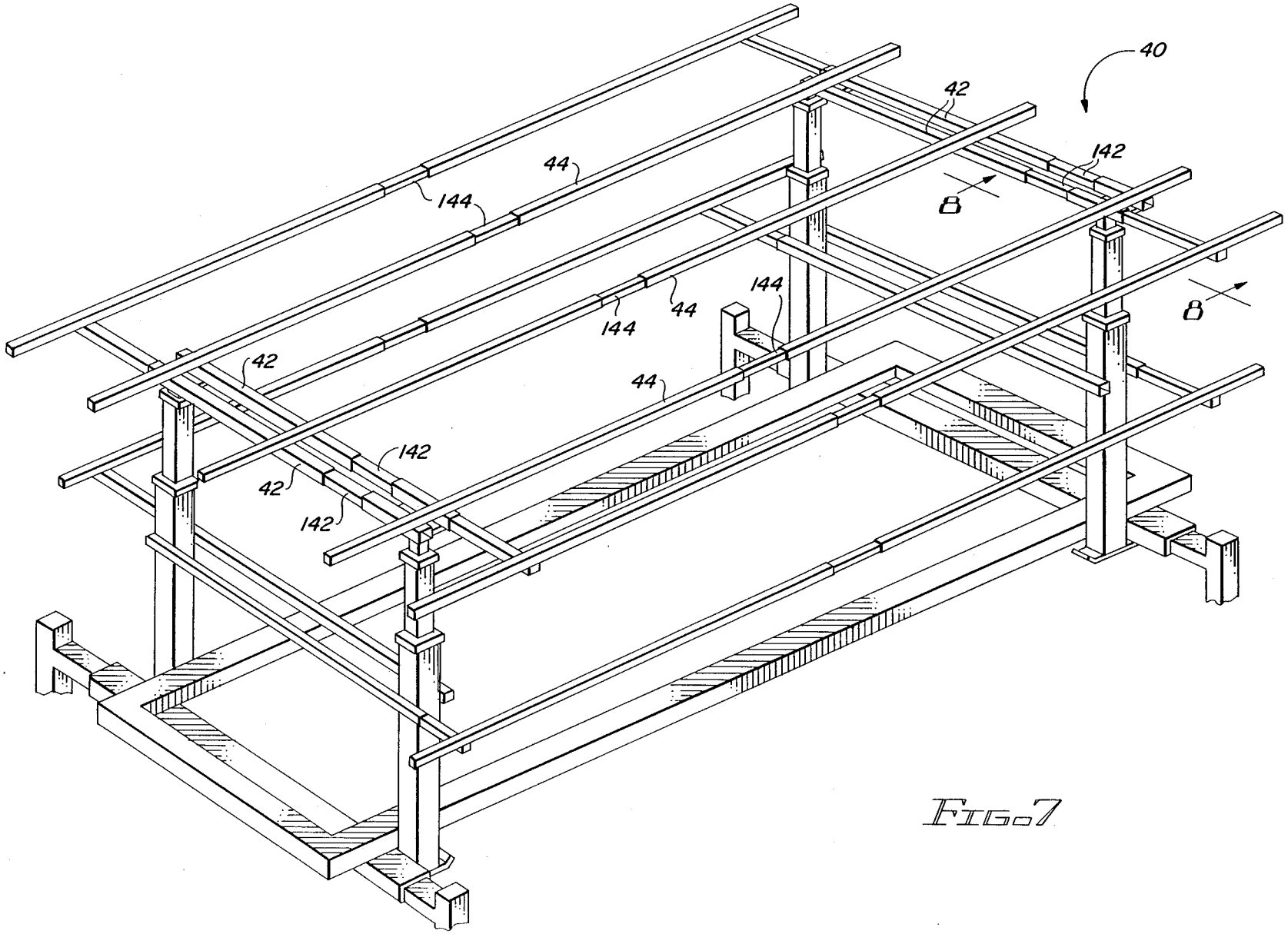
FIG. 7 is a perspective view of another embodiment of a framing structure.

Reference is now made to FIG. 7 which illustrates a framing structure similar to the framing structure 10 of FIG. 1. In this embodiment, longitudinal roof beams 44 are cut and provided with internal splicing beams 144 over which the longitudinal roof beams 44 can slide to effectively increase the length of the roof frame portion 40 as it is sloped longitudinally. The transversely telescoping roof beams 42 are also severed and provided with splicing bars 142 over which the transversely telescoping roof beams 42 slide to effectively increase the width of the roof frame portion 40 as it is sloped transversely. Additionally, instead of the track-sliding plate connection of FIG. 2, the roof frame portion 40 is connected to the upper ends of the telescoping beams 30 by way of ball joints or the like so that the roof frame portion can have either a single slope or a double slope without a need for changing the joint. Thus, the roof frame portion could be sloped both longitudinally and transversely at the same time.

Figure 8:
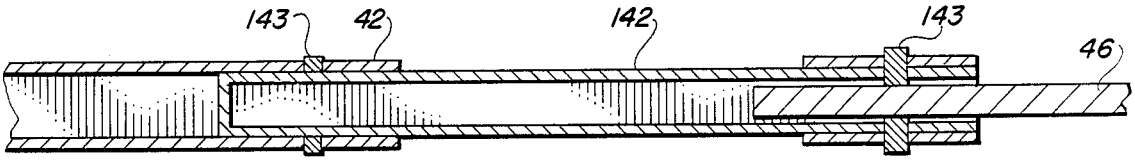
FIG. 8 is a section view 8—8 of FIG. 7.

Reference is made to FIG. 8 which illustrates a cross-sectional view of a transversely telescoping roof beam 42 with the splicing bar 142 and the telescoping portion 46. Here, each member is dimensioned so that the telescoping portion 46 can slide within the splicing beam 142 which can slide within the transversely telescoping roof beam 42. Pressure pins 143 are provided to lock the members together once they are in the desired position.

Figure 9:
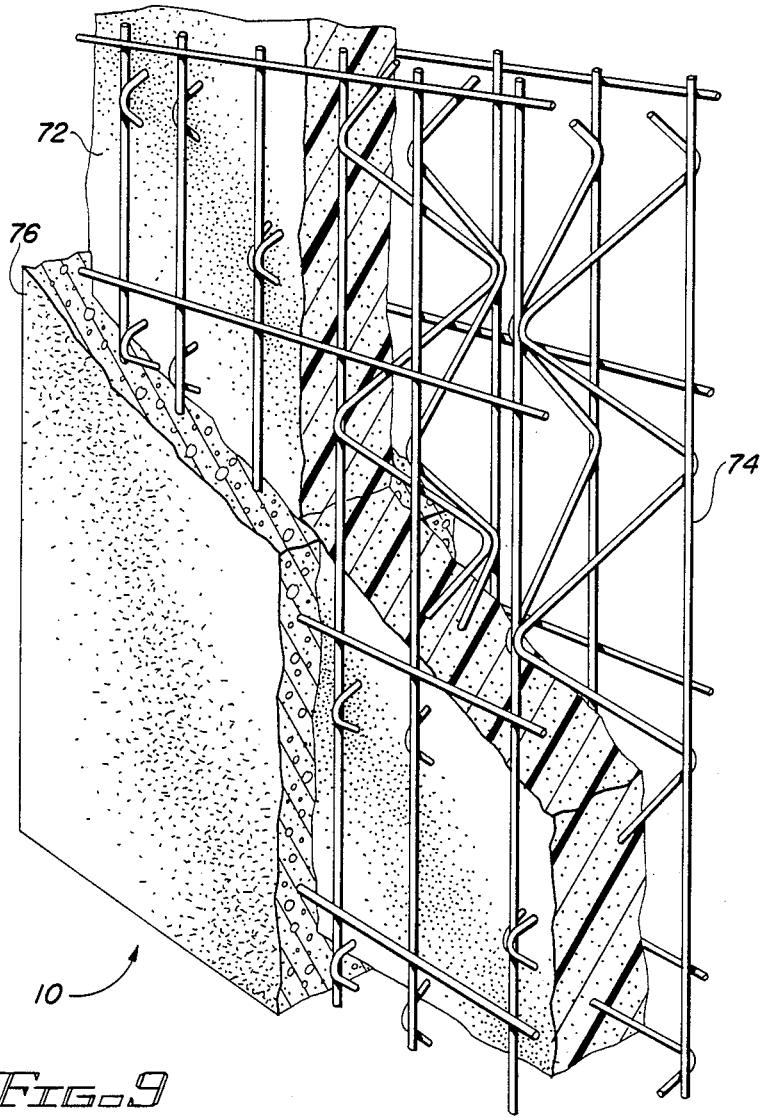
FIG. 9 is a perspective view of a wire matrix panel which can be attached to a framing structure.

Reference is now made to FIG. 9 which shows a three-dimensional wire matrix panel 70 which is attached to the outside of the framing structure 10, once the members of the framing structure 10 have been extended to the desired size and shape of the building to be constructed. The wire matrix panel 70 has a polyurethane insulation core 72 with the wire matrix 74 protruding from both faces of the insulation core 72. Panels of this type can be obtained from Truss-Tech Building Systems of Fontana, CA. Fluent concrete 76, or the like, is then introduced to the outside faces of the wire matrix panels 70 thus forming a reinforced concrete structure.

Figure 10:
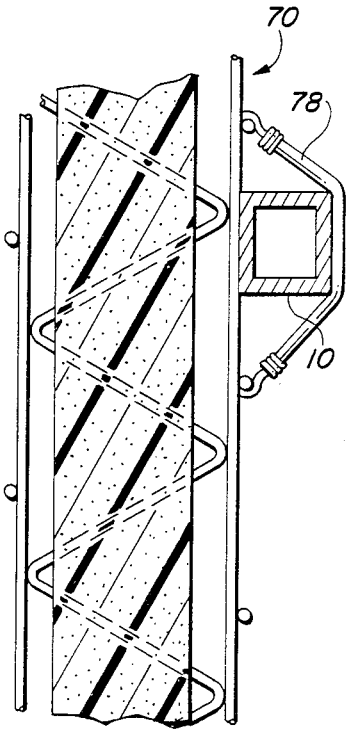
FIG. 10 is a section view of a wire matrix panel attached to a member of a framing structure.

Reference is now made to FIG. 10 which shows the attachment of a wire matrix panel 70 to the framing structure 10. The panel 70 can be removably attached to the framing structure 10 by elastic hooked cords 78 well known in the art. The cords 78 are hooked at one end to the inside face of the panel 70, wrapped over a member of the framing structure 10, and hooked at the other end to another portion of the panel 70. Once the panels are in place, fluent concrete, or the like, can be introduced, preferably under pressure by spraying to the outside faces of the panel 70. After the concrete has hardened in situ the cords 78 can be disconnected and the framing structure 10 can be retracted within the building. One of the walls of the building must remain unassembled until the framing structure 10 is removed. Once the framing structure 10 has been removed, the final wall can be assembled and fluent concrete or the like can be introduced to the inside surfaces of the panels 70. Additionally, windows, doors and other openings can be provided in buildings formed by the framing structure 10 by refraining from placing panels 70 where such openings are desired.

FIGS. 11 through 26, while not comprehensive, show numerous shaped buildings that can be constructed with the present invention. Reference is made to FIGS. 11 and 12 which illustrate a rectangular building 90 constructed with a single framing structure similar to the framing structure 10 of FIG. 1. FIGS. 13 and 14 illustrate a building 90 having a pitched roof, formed by a single framing structure similar to the framing structure 10 of FIG. 1. The pitched roof is formed by raising two masts 30 which are on a single longitudinal side. FIGS. 15 and 16 illustrate a building having nonparallel vertical walls. This shape can be accomplished by outwardly telescoping a pair of transversely telescoping roof beams and a pair of transversely telescoping intermediate beams 52 which traverse the same masts 30 such that the longitudinal rafter beams 48 are parallel with the corresponding intermediate beams 58.

FIGS. 17 and 18 show a building 90 having a horizontal roof portion 92, two pitched side roof portions 94, and two vertical side walls 96. This shape can be accomplished with a single framing structure, similar to the framing structure 10 shown in FIG. 1, by retracting the transversely telescoping roof beams 44 and outwardly telescoping the transversely telescoping intermediate beams 52.

FIGS. 19 and 20 show a rectangular building having a longitudinally pitched roof. The shape of this building 90 can be accomplished with a single framing structure 10, as shown in FIG. 1, by upwardly telescoping two masts 30 on a single transverse side. FIGS. 21 and 22 show a building 90 having a gabled roof. This shape can be accomplished by two framing structures similar to the framing structure 10 of FIG. 1. Here, two framing structures 10 are placed side by side with each roof portion 40 sloped outward.

FIGS. 23 and 24 show an L-shaped building 90 similar to the framing structure 10 of FIG. 1. Here, two framing structures 10 are positioned in the form of an "L". FIGS. 25 and 26 illustrate a tall building 90 formed with two framing structures similar to the framing structure 10 of FIG. 1. Here, the framing structures 10 are stacked one on top of the other and the members of the structures are extended to form the desired shape of the building 90.

While the principles of the invention have now been made clear in an illustrative embodiment, it will become obvious to those skilled in the art that many modifications in structure, arrangement, portions, materials and components may be used in the practice of the invention and which are otherwise particularly adapted for specific building requirements without departing from those principles. The appended claims are therefore intended to cover and embrace any such modifications, within the limits of only the true spirit and scope of the invention.

I claim:

1. An apparatus on which forms may be mounted for forming the shape of a building during construction and which can thereafter be removed for reuse once the building is formed, comprising:

(a) a framing structure for defining the building shape, said structure having at least four spaced masts, two transverse beams each having at least one telescoping free end and each being transversely mounted respectively on a first and second pair of said masts, and a shape forming beam carried on said free ends of said transverse beams;

(b) means for expanding a dimension of said framing structure to increase a corresponding dimension of the building through outward projection of said shape forming beam by projecting said free ends of said transverse beam outwardly; and (c) means for varying the shape of said framing structure so that various shaped buildings can be constructed with said framing structure, including means for changing the outward projection of one end of said shape forming beam relative to the other end of said shape forming beam by changing the relative outward projections of said free ends of said transverse beams and pivoting said shape forming beam relative to said free ends, without changing the relative spacing of said masts.

2. An apparatus as in claim 1, wherein said masts comprise first and second pairs of spaced masts, wherein said shaped forming beam is a first shape forming beam, and wherein said means for expanding a dimension of said framing structure comprises means for expanding a horizontal dimension of said framing structure; said apparatus further comprising third and fourth transverse beams having telescoping free ends and being respectively mounted on said first and second pairs of masts, a second shape forming beam carried on said free ends of said third and fourth transverse beams, means for expanding a second horizontal dimension of said framing structure to increase a corresponding second dimension of said building through outward projection of said second shape forming beam by projecting said free ends of said third and fourth transverse beams outwardly in a direction opposite to the direction of outward projection of said first shape forming beam; and said means for varying the shape of said framing structure further including means for changing the outward projection of one end of said second shape forming beam relative to the other end of said second shape forming beam by changing the relative outward projections of said free ends of said third and fourth transverse beams and pivoting said second shape forming beam relative to said free ends of said third and forth transverse beams, without changing the spacing of said masts.

3. An apparatus as in claim 1, wherein each of said transverse beams comprises first and second longitudinal beams axially aligned end-to-end, and an insert received within the opposing ends of the longitudinal beams to join them together in longitudinally movable fashion, thereby providing means for extending the spacing between the masts on which the transverse beams are mounted.

4. An apparatus as in claim 2, wherein said masts are telescoping masts having upper and lower ends; wherein said apparatus further comprises first and second roof shape forming beams respectively carried on said upper ends of a first two and a second two of said masts;

means for expanding a vertical dimension of said framing structure to increase a corresponding dimension of the building through upward projection of said first and second roof shape forming beams by projecting said upper ends of said first and second two of said masts upwardly; and wherein said means for varying the shape of said framing structure further includes means for changing the upward projection of one end of said first roof shape forming beam relative to the other end of said first roof shape forming beam by changing the relative upward projections of said upper ends of said first two masts and pivoting said first roof shape forming beam relative to said upper ends of said first two masts, without changing the relative spacing of said masts, and means for changing the upward projection of one end of said second roof shape forming beam relative to the other end of said second roof shape forming beam by changing the relative upward projections of said upper ends of said second two masts and pivoting said second roof shape forming beam relative to said upper ends of said second two masts without changing the relative spacing of the masts.

5. An apparatus as in claim 2, wherein said means for changing the relative upward projections of the ends of said roof shape forming beams further comprises means for pivotally connecting said roof shape forming beams to the upper ends of said masts.

6. An apparatus as in claim 5, wherein said pivotally connecting means comprises a ball joint at each end of said roof shape forming beams.

7. An apparatus as in claim 5, wherein said pivotally connecting means comprises:

(a) horizontal plates attached to the upper ends of said masts;

(b) a pair of spaced vertical plates with aligned bores attached to project upwardly from each said horizontal plate;

(c) a vertical pivot plate received between each pair of spaced plates and having a bore aligned with the bores of said spaced plates;

(d) a pin passing through said aligned bores pivotally connecting said pivot plate to said spaced plates;

(e) a horizontal sliding plate attached atop each pivot plate; and (f) a guide rail attached to each of said roof shape forming beams and having a track slidably capturing said sliding plate.

8. An apparatus as in claim 1, wherein said means for changing the relative outward projections further comprises said shape forming beam having a longitudinal slot near each of its ends, and pins respectively passing through said slots and connecting to said free ends of said transverse beams.

9. An apparatus as in claim 2, wherein said framing structure further comprises vertically-spaced upper and lower portions, said transverse beams all being mounted in said upper portion, and said lower portion having two longitudinally extending lower beams respectively mounted on said lower ends of said first and second pairs of masts; and two transverse lower beams respectively connecting the ends of said longitudinally extending lower beams.

10. An apparatus as in claim 9, further comprising jacking means attached to said lower portion for leveling said framing structure.

11. An apparatus as in claim 10, further comprising means for projecting said jacking means outwardly relative to said framing structure.

12. An apparatus as in claim 9, further comprising rolling means attached to said lower portion for transporting and positioning said framing structure.

13. An apparatus as in claim 12, further comprising jacking means attached to said lower portion for leveling said framing structure.

14. An apparatus on which forms may be placed for forming the shape of a building during construction and which can thereafter be removed for reuse once the building is formed, comprising:

(a) a framing structure for defining the building shape, said structure having a plurality of spaced masts, two transverse beams each having a telescoping free end and each being mounted on a respective pair of said masts, and a shape forming beam carried on said free ends of said transverse beams;

(b) means for expanding a dimension of said framing structure to increase a corresponding dimension of the building through outward projection of said shape forming beam by projecting said free ends of said transverse beams outwardly; and (c) means for varying the shape of said framing structure so that various shaped buildings can be constructed with said framing structure, including means for changing the outward projection of one end of said shape forming beam relative to the other end of said shape forming beam by changing the relative outward projections of said free ends of said transverse beams; said means for changing the relative outward projections comprising said shape forming beam having longitudinal slots at its ends, and pins respectively passing through said slots and connecting to said free ends of said transverse beams.

15. An apparatus for forming the shape of a building during construction by providing a framework for attachment of building forms against which concrete or similar substance can be formed and permitted to harden, and which can thereafter be removed from the hardened concrete and building forms for reuse once the building is formed, comprising:

(a) a framing structure for defining the building shape, said structure having four vertical masts spaced apart in parallel first and second pairs, said masts having upper and lower ends; and a roof portion having first and second roof transverse beams mounted on the upper ends respectively of said first and second pairs of masts and each having a telescoping free end, a first roof shape forming beam mounted on the free ends of said first and second roof transverse beams for movement therewith, third and, fourth roof transverse beams mounted on the upper ends respectively of said first and second pairs of masts and each having a telescoping free end, said free ends of said third and fourth roof transverse beams telescoping in a direction opposite to the free ends of said first and second roof transverse beams, and a second roof shape forming beam mounted on the free ends of said third and fourth roof transverse beams for movement therewith;

(b) means for expanding a width dimension of said roof portion to increase a corresponding width dimension of the building through outward projection of said first roof shape forming beam by projecting said free ends of said first and second roof transverse beams outwardly, and through outward projection of said second roof shape forming beam by projecting said free ends of said third and fourth roof tansverse beams outwardly in a direction opposite to the direction of outward projection of said first roof tansverse beam; and (c) means for varying the shape of said roof portion so that various shaped buildings can be constructed with said framing structure, including means for changing the outward projection of one end of said first roof shape forming beam relative to the other end of said first roof shape forming beam by changing the relative outward projections of said free ends of said first and second roof transverse beams and pivoting said first roof shaping beam relative to said free ends of said first and second roof transverse beams, without changing the relative spacing of said masts; and means for changing the outward projection of one end of said second roof shape forming beam relative to the other end of said second roof shape forming beam by changing the relative outward projections of said free ends of said third and fourth roof transverse beams and pivoting said second roof shaping beam relative to said free ends of said third and fourth roof transverse beams, without changing the relative spacing of said masts.

16. An apparatus as in claim 15, said framing structure further having:

(a) an intermediate portion having first and second intermediate transverse beams mounted between the upper and lower ends respectively of said first and second pairs of masts and each having a telescoping free end, a first wall shape forming beam mounted on the free ends of said first and second intermediate transverse beams for movement therewith, third and fourth intermediate transverse beams mounted between the upper and lower ends respectively of said first and second pairs of masts and each having a telescoping free end, said free ends of said first and second intermediate transverse beams telescoping in a direction opposite to the free ends of the third and fourth intermediate transverse beams, and a second wall shape forming beam mounted on the free ends of said third and fourth intermediate transverse beams for movement therewith; and, further comprising:

(b) means for expanding a width dimension of said intermediate portion to increase a corresponding width dimension of the building through outward projection of said first wall shape forming beam by projecting said free ends of said first and second intermediate transverse beams outwardly, and through outward projection of said second wall shape forming beam by projecting said free ends of said third and fourth intermediate transverse beams outwardly in a direction opposite to the direction of outward projection of said first wall shape forming beam; and (c) means for varying the shape of said intermediate portion, including means for changing the outward projection of one end of said first wall shape forming beam relative to the other end of said first wall shape forming beam by changing the relative outward projections of said free ends of said first and second intermediate transverse beams and pivoting said first wall shape forming beam relative to said free ends of said first and second intermediate transverse beams, without changing the relative spacing of said masts, and means for changing the outward projection of one end of said second wall shape forming beam relative to the other end of said second wall shape forming beam by changing the relative outward projections of said free ends of said third and fourth intermediate transverse beams and pivoting said second wall shape forming beam relative to said free ends of said third and fourth intermediate transverse beams, without changing the relative spacing of said masts.

17. An apparatus as in claim 16, wherein said masts comprise telescoping masts; wherein said roof portion further comprises a third roof shape forming beam mounted on the upper ends of first masts of said first and second pairs of masts and a fourth roof shape forming beam mounted on the upper ends of second masts of said first and second pairs of masts; further comprising means for expanding a vertical dimension of said roof portion through upward projection of said third roof shape forming beam by projecting said upper ends of said first masts upwardly, and through upward projection of said fourth roof shape forming beam by projecting said upper ends of said second telescoping masts upwardly; and wherein said means for varying the shape of said roof portion further includes means for changing the upward projection of one end of said third roof shape forming beam relative to the other end of said third roof shape forming beam by changing the relative upward projections of said upper ends of said first masts and pivoting said third roof shape forming beam relative to said upper ends of said first masts, wihout changing the relative spacing of said masts, and means for changing the upward projection of one end of said fourth roof shape forming beam by changing the relative upward projections of said upper ends of said second telescoping masts and pivoting said fourth roof shape forming beam relative to said upper ends of said second masts, without changing the relative spacing of said masts.

18. An apparatus as in claim 17, wherein said framing structure further comprises a lower portion having two longitudinally extending beams respectively mounted on said lower ends of said first and second pairs of masts; and two transverse beams respectively connecting the ends of said longitudinally extending beams.

19. An apparatus as in claim 18, further comprising jacking means attached to said lower portion for leveling said framing structure.

20. An apparatus as in claim 19, further comprising means for projecting said jacking means outwardly relative to said framing structure.

21. An apparatus as in claim 18, further comprising rolling means attached to said lower portion for transporting and positioning said framing structure.

22. An apparatus as in claim 21, further comprising jacking means attached to said lower portion for leveling said framing structure.

* * * * *